US007441651B1

(12) United States Patent
Sullivan

(10) Patent No.: US 7,441,651 B1
(45) Date of Patent: Oct. 28, 2008

(54) AUTOMOBILE REMOTE CONTROL COVER WITH KEY RING

(76) Inventor: Samuel Rupert Sullivan, 5115 Boulder Dr., Oxon Hill, MD (US) 20745-3714

( * ) Notice: Subject to any disclaimer, the term of this patent is extended or adjusted under 35 U.S.C. 154(b) by 419 days.

(21) Appl. No.: 11/261,606

(22) Filed: Oct. 31, 2005

Related U.S. Application Data

(60) Provisional application No. 60/595,025, filed on May 30, 2005.

(51) Int. Cl.
*A45C 11/32* (2006.01)
*A44B 15/00* (2006.01)
*A47G 29/10* (2006.01)
*G08C 19/00* (2006.01)

(52) U.S. Cl. ..... 206/38.1; 206/37.1; 70/456 R; 340/825.69

(58) Field of Classification Search ..... 206/37.1–37.8, 206/38.1; 70/456 R, 408; 340/5.6, 5.64, 340/825.69
See application file for complete search history.

(56) References Cited

U.S. PATENT DOCUMENTS 1,726,569 A * 9/1929 Kasting ..... 206/37.2
1,999,290 A * 4/1935 Goessling ..... 206/37.8
3,362,200 A * 1/1968 Lanier ..... 70/456 R
4,660,792 A 4/1987 Rogalski
4,733,776 A 3/1988 Ward
4,836,256 A 6/1989 Melicone
4,888,970 A * 12/1989 Kinzler et al. ..... 70/456 R
5,092,459 A 3/1992 Uljanic et al.
5,117,666 A * 6/1992 Keefer ..... 70/456 R
5,195,634 A 3/1993 Zaud
5,220,319 A * 6/1993 Kendel ..... 340/825.69
5,265,720 A 11/1993 Meliconi
5,305,980 A 4/1994 Le Blanc
5,316,141 A 5/1994 Jalomo
D355,302 S 2/1995 Eva et al.
5,388,691 A 2/1995 White
5,388,692 A 2/1995 Withrow
D356,440 S * 3/1995 Stillwagon ..... D3/208
D368,095 S 3/1996 McCallister, III (Continued)

FOREIGN PATENT DOCUMENTS

EP 0 708 463 4/1996

(Continued)

*Primary Examiner*—Bryon P Gehman
(74) *Attorney, Agent, or Firm*—Swift Law Office; Stephen Christopher Swift

(57) ABSTRACT

A protective cover for an automobile remote control, comprising a flat rectangular middle section and two side sections. The side sections are parallel and at right angles to the middle section, and are on the same side of the middle section. The edges of the side sections, other than the edges that intersect the middle section, are curved, or otherwise configured, to match the shape of the remote control, with both side sections preferably having the same shape. The remote control is inside the cover, retained between the side sections, when it is not in use. The remote control can be pivoted outside the cover, so that it can be used. A key ring that acts as a pivot passes through holes in the side sections of the cover, a hole in the remote control, and holes in one or more keys or other objects retained on the key ring.

3 Claims, 6 Drawing Sheets

U.S. PATENT DOCUMENTS

| | | | | |
|---|---|---|---|---|
| D378,020 | S | 2/1997 | Hatt | |
| 5,678,204 | A | 10/1997 | Naylor | |
| D395,355 | S * | 6/1998 | von Freiberg | D3/208 |
| D409,200 | S | 5/1999 | Cooper | |
| 5,931,434 | A | 8/1999 | Rodriguez | |
| 6,050,407 | A | 4/2000 | Trujillo | |
| 6,155,416 | A | 12/2000 | Jaime | |
| D449,446 | S | 10/2001 | Kirchner et al. | |
| 6,533,111 | B1 * | 3/2003 | Harden | 206/38.1 |
| 6,684,673 | B2 * | 2/2004 | Florendo | 70/456 R |
| 6,705,141 | B1 * | 3/2004 | Jacob et al. | 70/408 |
| 6,772,881 | B2 | 8/2004 | Le et al. | |
| 6,786,332 | B1 | 9/2004 | Patrick et al. | |
| 2002/0008610 | A1 | 1/2002 | Peterson | |
| 2004/0033788 | A1 | 2/2004 | Price | |
| 2007/0040648 | A1 * | 2/2007 | Bernard | 340/5.64 |

FOREIGN PATENT DOCUMENTS

| | | |
|---|---|---|
| FR | 2 762 955 | 11/1998 |
| JP | 2002-142282 | 5/2002 |

* cited by examiner

AUTOMOBILE REMOTE CONTROL COVER WITH KEY RING

CROSS REFERENCE TO RELATED APPLICATION

This application is based on and claims the benefit of Provisional Patent Application Ser. No. 60/595,025, filed May 30, 2005.

BACKGROUND OF THE INVENTION

1. Field of the Invention

The present invention relates to protective covers for automobile remote controls and similar objects.

2. Description of the Prior Art

There have been previous inventions of covers for protecting remote controls from damage, but none that are equivalent to the present invention.

U.S. Pat. No. 4,660,792, issued on Apr. 28, 1987, to Lawrence D. Rogalski, discloses a holder for VCR and TV remote controls, with pockets for the remote controls and a cover that can be folded over the pockets. The instant invention is distinguishable, in that it does not have a foldable cover.

U.S. Pat. No. 4,733,776, issued on Mar. 29, 1988, to Keith Ward, discloses a protective device for a remote control unit, including a foam panel and a flexible, transparent elastic member.

U.S. Pat. No. 4,836,256, issued on Jun. 6, 1989, to Loris Meliconi, discloses a shockproof protective sheath for remote controls, in particular those of television receivers, with at least two openings: one opening for access to push buttons, and the other opening to allow passage of control pulses.

U.S. Pat. No. 5,092,459, issued on Mar. 3, 1992, to Daniel Uljanic and Teresa L. Uljanic, discloses a transparent plastic case as a cover for a remote control unit.

U.S. Pat. No. 5,195,634, issued on Mar. 23, 1993, to Gregory P. Zaud, discloses a remote control holder having two halves that fold together like a book to completely cover the remote control.

U.S. Pat. No. 5,265,720, issued on Nov. 30, 1993, to Loris Meliconi, discloses a shock-proof protective jacket for a remote control unit, made of an elastic material.

U.S. Pat. No. 5,305,980, issued on Apr. 26, 1994, to James F. Le Blanc, discloses a remote control unit holder, with an open top and closed sides and bottom. The instant invention is distinguishable, in having open sides.

U.S. Pat. No. 5,316,141, issued on May 31, 1994, to Bernabe F. Jalomo, discloses a remote control cover having four walls, a bottom, and a flap which is folded over an open top.

U.S. Pat. No. 5,388,691, issued on Feb. 14, 1995, to Nona J. White, discloses a protective case for a remote control, including a rigid clear plastic cover that is slidable by one's thumb, and an opening to receive a key chain ring.

U.S. Pat. No. 5,388,692, issued on Feb. 14, 1995, to Joseph E. Withrow, Larry S. Gibbs and Reginald Washington, discloses a protective cover for a remote control unit, having a resilient housing and a light source.

U.S. Pat. No. 5,678,204, issued on Oct. 14, 1997, to Richard C. Naylor, discloses a protective cover for an electronic device, which covers the sides of the device. The instant invention is distinguishable, in that it has open sides.

U.S. Pat. No. 5,931,434, issued on Aug. 3, 1999, to Luis Rodriguez, discloses a protector for remote control devices including a slotted elongated tubular member that surrounds the edges of the device.

U.S. Pat. No. 6,050,407, issued on Apr. 18, 2000, to Paul M. Trujillo, discloses a remote control cover having a sheath of a thin flexible plastic film that is wrapped around the control unit and is self-adherent.

U.S. Pat. No. 6,155,416, issued on Dec. 5, 2000, to Martin Jaime, discloses a protective housing adapted for covering a remote transmitter for a car alarm, with first and second sections that are hinged. The instant invention is distinguishable, in that its sections are not hinged.

U.S. Pat. No. 6,772,881, issued on Aug. 10, 2004, to Scott C. Le and Quynh-Nhu Thi Tran, discloses a remote control cover, having a body with a plurality of window openings, and a closure flap with hook and loop fastening material (or VELCRO).

U.S. Pat. No. 6,786,332, issued on Sep. 7, 2004, to Ralph J. Patrick and Marva E. Patrick, discloses a protective holder for a remote control, having a hinged lid with a latching mechanism.

U.S. Pat. No. Des. 355,302, issued on Feb. 14, 1995, to Shawn R. Eva and Myron R. McCallister, III, discloses a design for a remote control cover, which, unlike the instant invention, completely covers the remote control, has a flap, and is transparent.

U.S. Pat. No. Des. 368,095, issued on Mar. 19, 1996, to Myron R. McCallister, III, discloses a design for a remote control cover, which covers the sides, top and bottom of the remote control.

U.S. Pat. No. Des. 378,020, issued on Feb. 18, 1997, to Jody D. Hatt, discloses a design for a combined remote control cover and protector, having an open bottom end and a transparent window in the front.

U.S. Pat. No. Des. 409,200, issued on May 4, 1999, to Christopher A. Cooper, discloses a design for a remote control cover, which is closed on all sides, but has a transparent front window.

U.S. Patent No. D449,446, issued on Oct. 23, 2001, to Teresa L. Kirchner and Kevin F. Kirchner, discloses a design for a transparent remote control cover with a movable flap.

U.S. Patent Application Publication No. 2002/0008610, published on Jan. 24, 2002, to John Peterson, discloses a wireless key fob with a slidable cover.

U.S. Patent No. 2004/0033788, published on Feb. 19, 2004, to Venecia S. Price, discloses a case for holding a vehicle alarm transmitter, with a key ring and closed sides.

European Patent Application No. 0 708 463, published on Apr. 24, 1996, to Mario Fernandes Ribeiro, discloses a protector for remote controls, formed by a cover of flexible material which peripherally includes a tubular air chamber.

French Patent No. 2 762 955, published on Nov. 6, 1998, to Christopher Couton, discloses a hygienic protective cover for remote control units, made of a thin rubber material that is rolled up before use.

Japanese Patent No. 2002-142282, published on May 17, 2002, inventor Eri Inagaki, discloses a remote control device with a flip-type cover.

None of the above inventions and patents, taken either singly or in combination, is seen to describe the instant invention.

SUMMARY OF THE INVENTION

The present invention is a cover for an automobile remote control or similar object, having two side sections that cover the front and back of the remote control, connected by a middle section on one side of the remote control. A key ring that passes through holes in the cover and a hole in the remote control pivotally connects them, so that the remote control can swing out of the cover when needed for use, and can swing back into the cover when it is not in use. The cover prevents the buttons on the remote control from being accidentally activated, e.g., by rubbing against keys, a pocket knife, or other contents of a user's pocket, and protects the remote control from accidental damage.

Accordingly, it is a principal object of the invention to provide an apparatus for protecting the buttons of an automobile remote control from accidental activation.

It is another object of the invention to provide an apparatus for protecting an automobile remote control from scratching, cracking, breaking or other damage.

It is a further object of the invention to provide a protective cover for any remote control or similar object.

Still another object of the invention is to provide a method for protecting an automobile remote control or similar object by the use of a protective cover.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is a protective cover for a remote control. It is designed to cover a remote control for an automobile or other motor vehicle, but it may also be used to cover other kinds of remote controls or other kinds of objects.

Figure 1:
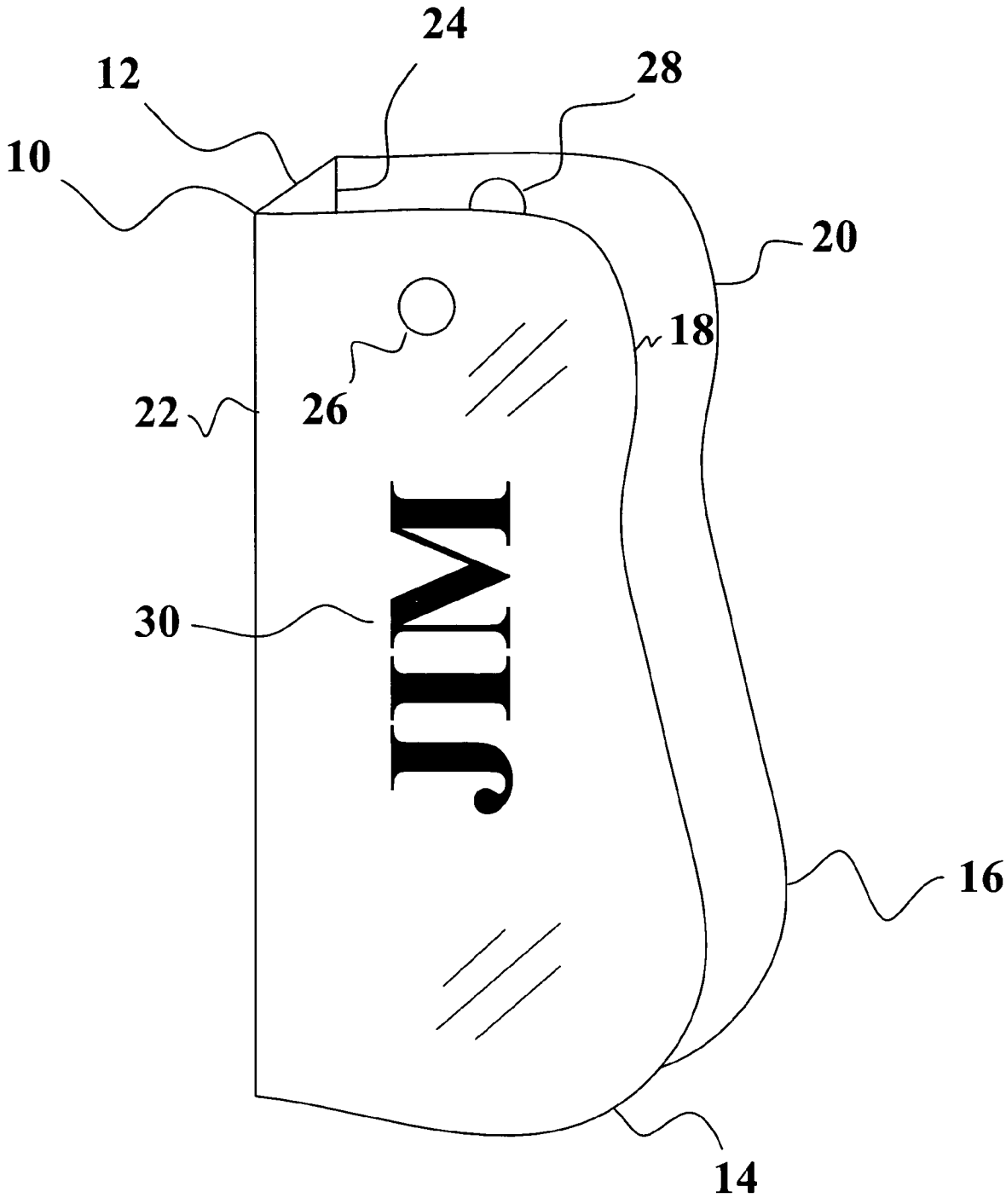
FIG. 1 is a perspective view of the preferred embodiment of the invention.
Figure 2:
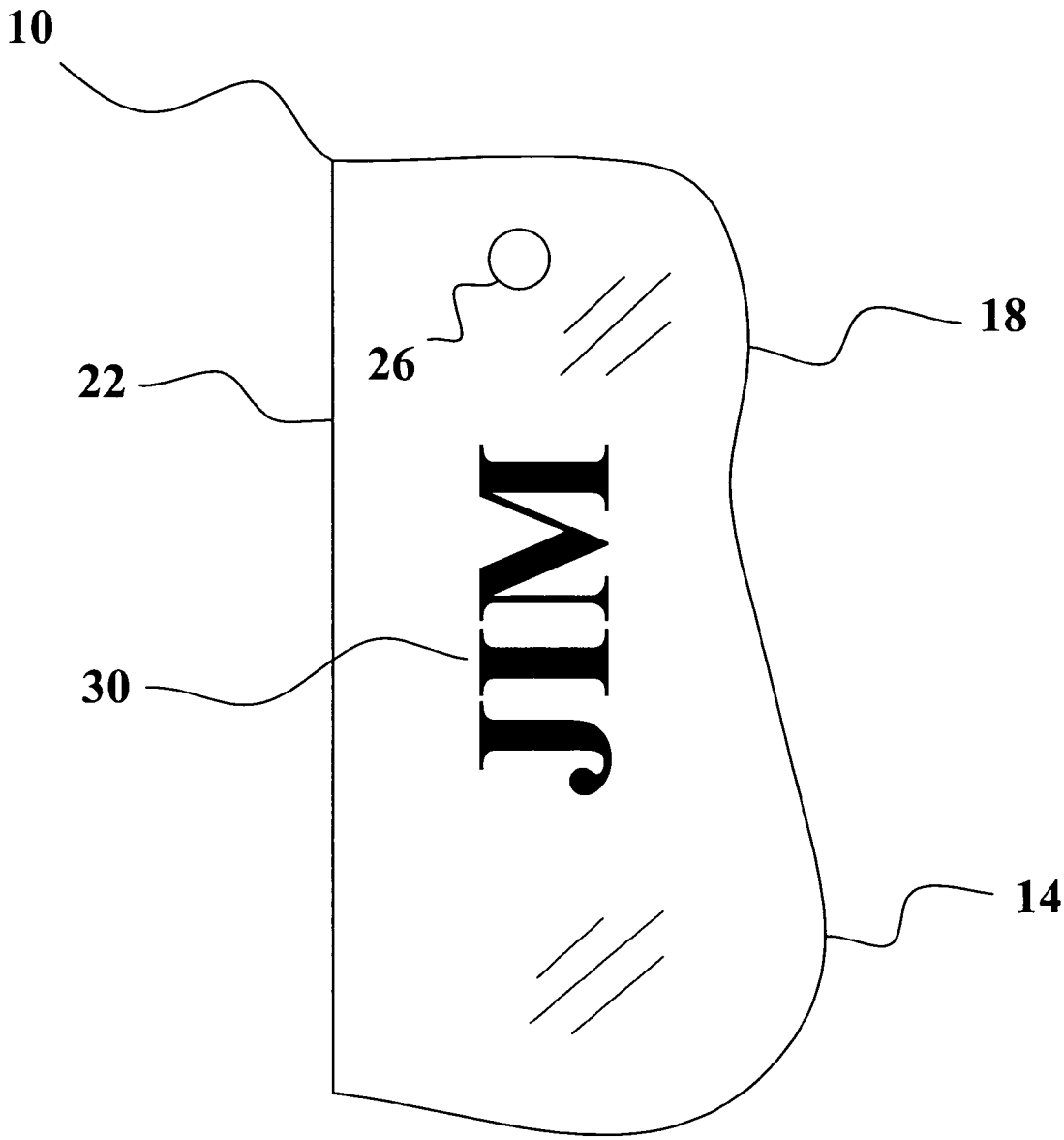
FIG. 2 is a front elevational view of the preferred embodiment of the invention.
Figure 3:
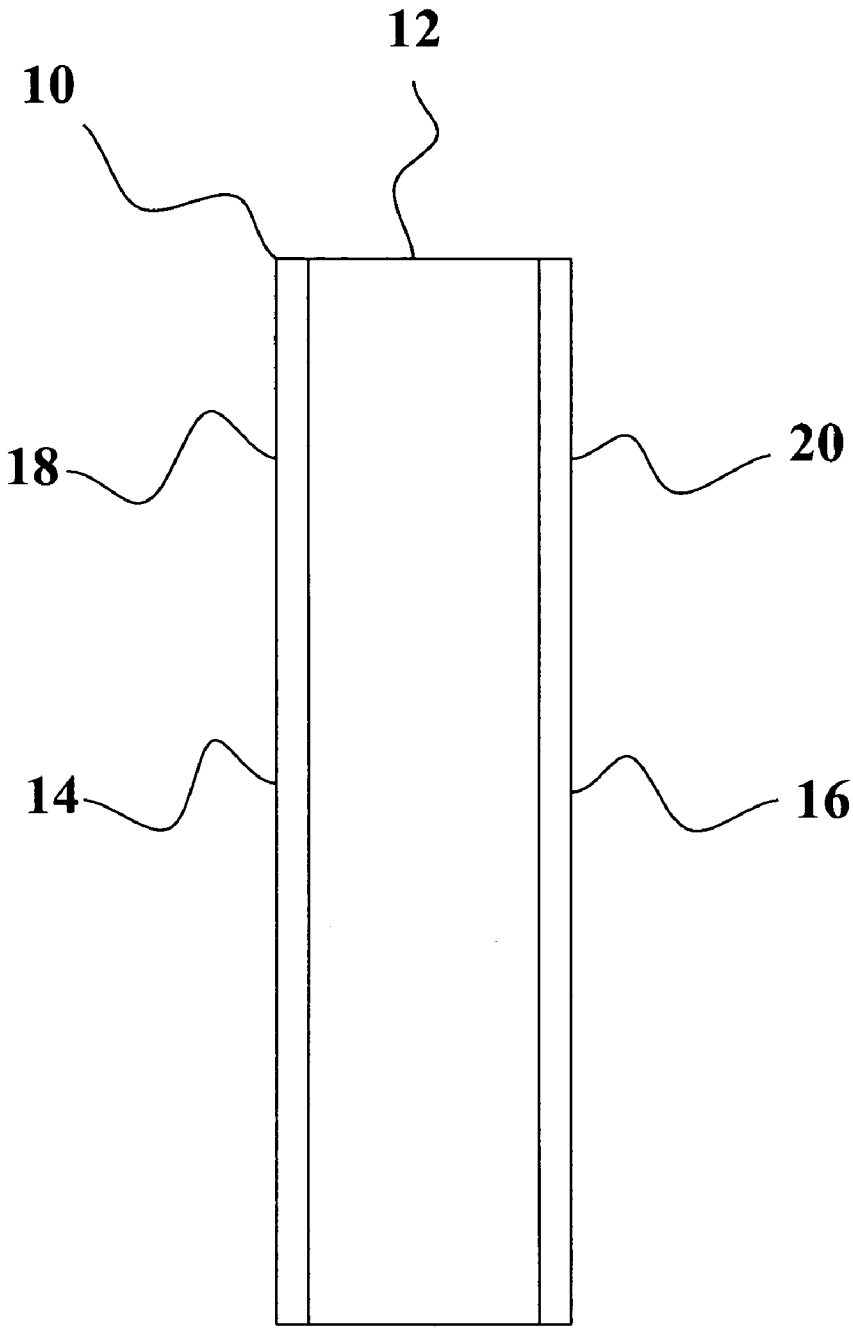
FIG. 3 is a right side elevational view of the preferred embodiment of the invention.
Figure 4:
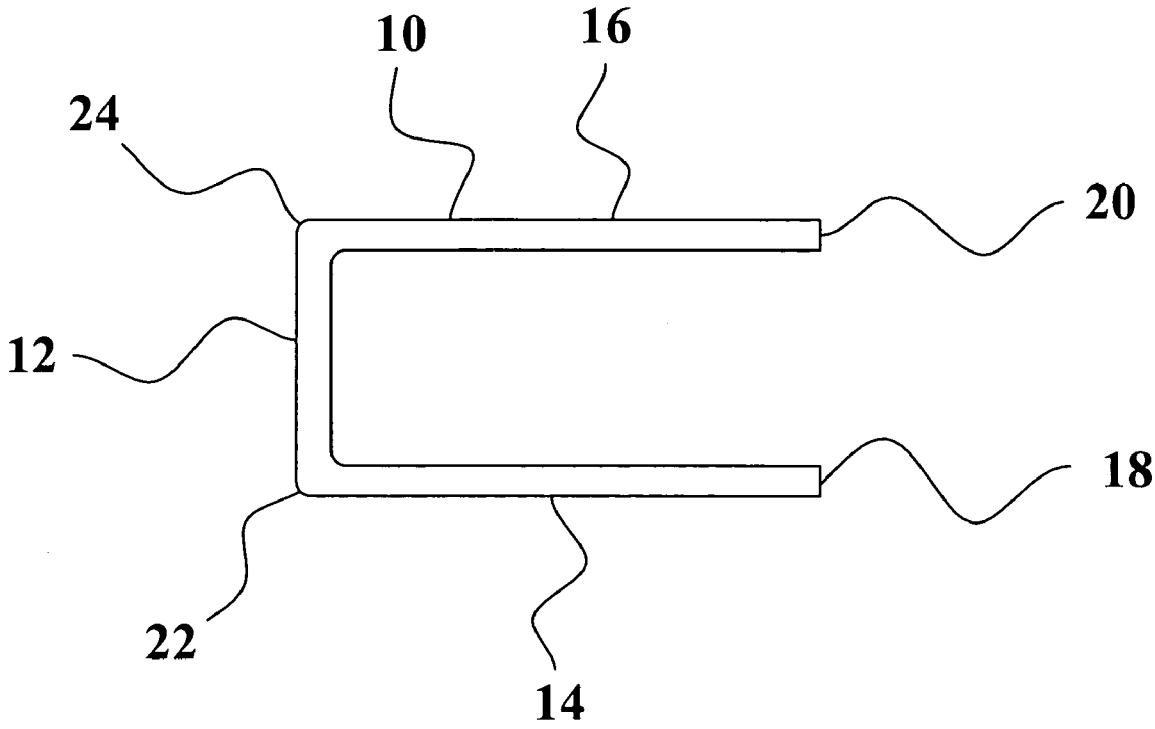
FIG. 4 is a top plan view of the preferred embodiment of the invention.

FIG. 1 is a perspective view of the preferred embodiment of the invention, which is a single sheet 10 having a flat rectangular middle section 12 and two side sections 14 and 16. The preferred embodiment of the invention is also shown in a front elevational view in FIG. 2, a right side elevational view in FIG. 3, and a top plan view in FIG. 4. The side sections are parallel and at right angles to the middle section, and are on the same side of the middle section. The edges 18 and 20 of the side sections (other than edges 22 and 24 that intersect the middle section) are curved (or otherwise configured) to match the shape of a remote control, with both side sections preferably having the same shape. There are holes 26 and 28 near the top of each side section, through which a key ring can be inserted. Insignia 30, such as the name or initials of the owner, may be engraved or otherwise placed on the cover.

Figure 5:
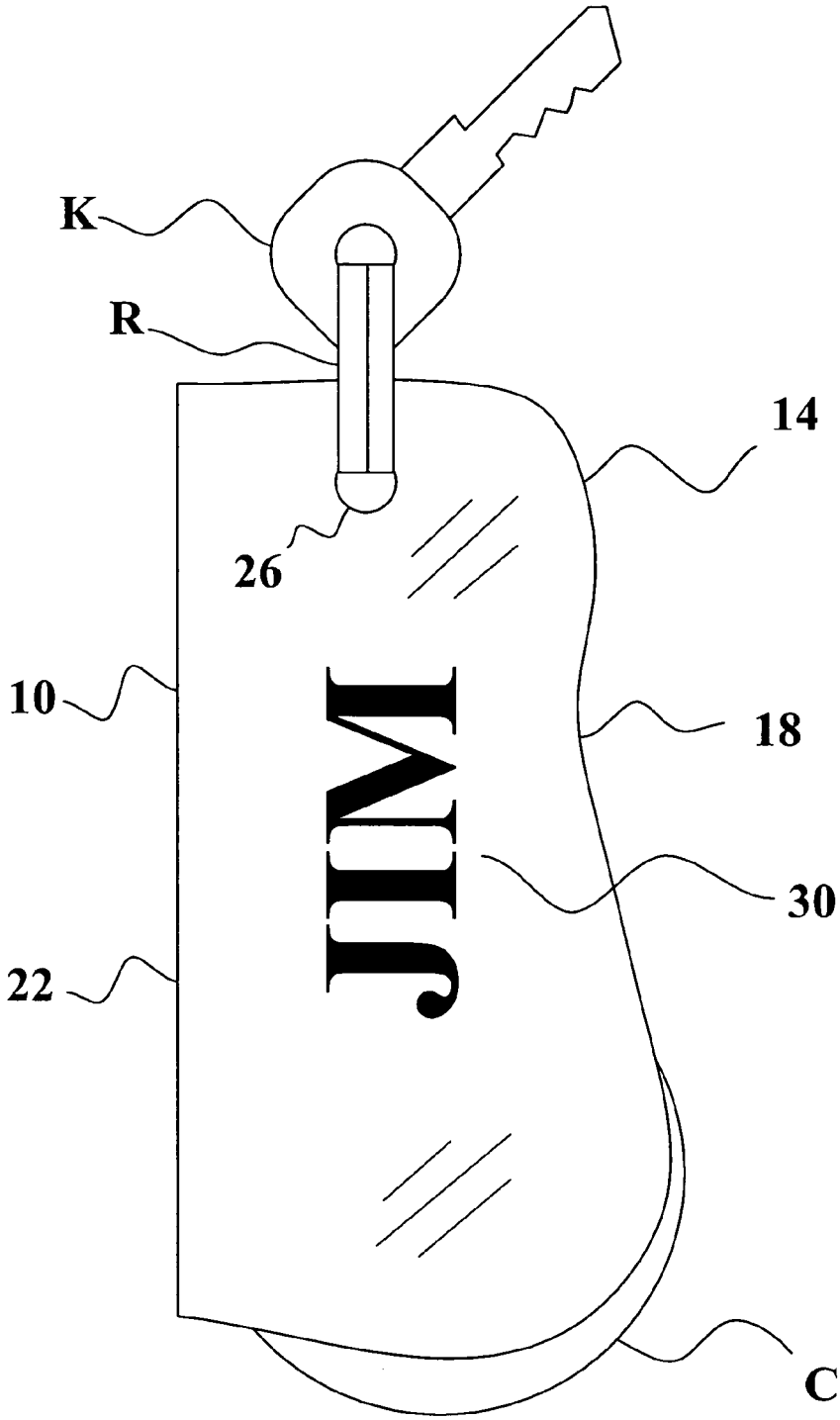
FIG. 5 is a front elevational view of the preferred embodiment of the invention and attached items, with the remote control inside the cover.
Figure 6:
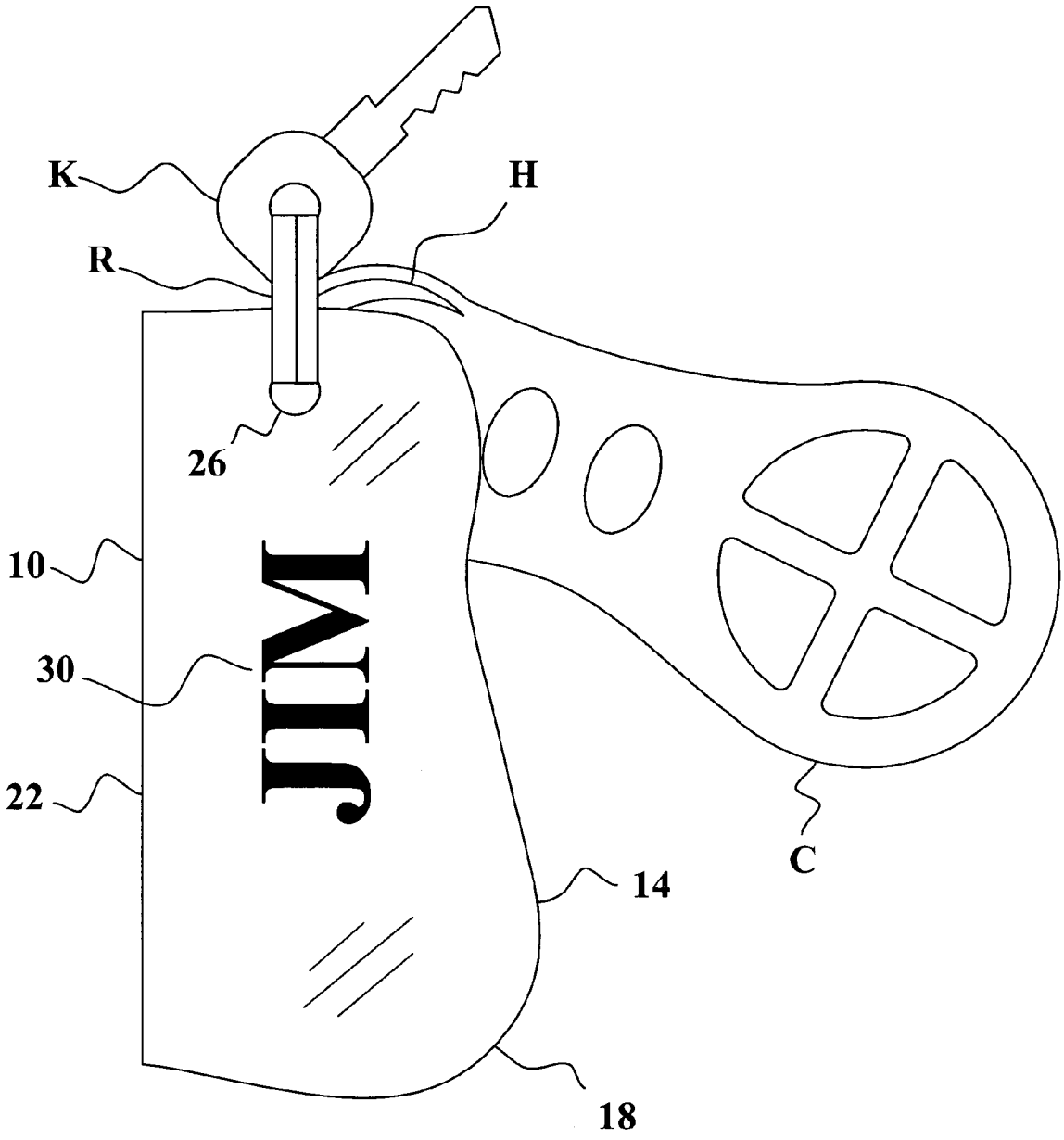
FIG. 6 is a front elevational view of the preferred embodiment of the invention and attached items, with the remote control outside the cover.

FIG. 5 is a perspective view of the preferred embodiment of the invention, showing the remote control C inside the cover, being retained between the side sections, as it will be when it is not in use. FIG. 6 is a perspective view of the preferred embodiment of the invention, showing the remote control when it has been pivoted outside the cover, so that it can be used. The key ring R passes through the holes in the side sections of the cover, the hole H in the remote control, and holes in one or more other objects retained on the key ring, such as the key K. When the remote control is pivoted outside or back inside the cover, the key ring acts as a pivot.

The cover is preferably made from metal, but may also be made from plastic or any other suitable material. It may be molded, formed from a single sheet that is cut and bent into its final shape, or formed from separate sheets that are integrally joined into a single sheet. It may be dimensioned and configured to cover a variety of remote controls or other objects.

The invention also includes the method of covering the remote control (or other object) using the cover described above, including the steps of:

1. Placing the remote control within the protective cover.
2. Inserting a key ring through the holes near the top of each side section of the cover, through a hole in the top of the remote control, and through holes in one or more keys or other objects.
3. Retaining the remote control between the side sections of the cover when it is not in use.
4. Pivoting the remote control out of the cover when it is to be used, with the key ring acting as a pivot.

It is to be understood that the present invention is not limited to the sole embodiment described above, but encompasses any and all embodiments within the scope of the following claims.

I claim:

1. A method of covering a remote control, comprising the steps of:

placing a remote control within a protective cover, formed from a single sheet, having a flat rectangular middle section and two flat side sections, the side sections being parallel and at right angles to the middle section, and on the same side of the middle section, with the edges of the side sections, other than edges that intersect the middle section, being curved to match the shape of the remote control, with both side sections having the same shape;

inserting a key ring through a hole near the top of each side section, through a hole in the remote control, and through holes in one or more keys;

retaining the remote control between the side sections of the cover when it is not in use; and pivoting the remote control out of the cover when it is to be used, with the key ring acting as a pivot.

2. The method of covering a remote control according to claim 1, wherein the remote control is for a motor vehicle.

3. The method of covering a remote control according to claim 2, wherein the motor vehicle is an automobile.

* * * * *